US006634999B2

(12) United States Patent
Herbst

(10) Patent No.: US 6,634,999 B2
(45) Date of Patent: Oct. 21, 2003

(54) LUMBAR STRETCHER

(76) Inventor: Barry Herbst, 341 Country Club Rd., Abbottstown, PA (US) 17301

( * ) Notice: Subject to any disclaimer, the term of this patent is extended or adjusted under 35 U.S.C. 154(b) by 100 days.

(21) Appl. No.: 09/939,807

(22) Filed: Aug. 28, 2001

(65) Prior Publication Data

US 2003/0045409 A1 Mar. 6, 2003

(51) Int. Cl.[7] ..... A63B 26/00

(52) U.S. Cl. ..... 482/142; 482/140; 482/148; D21/686

(58) Field of Search ..... 482/141, 907, 482/140, 91, 142, 129, 126, 121–123, 130, 148; D21/686, 662, 687–90; 606/242–3

(56) References Cited

U.S. PATENT DOCUMENTS 2,264,046 A * 11/1941 McClellan ..... 272/58
4,592,734 A * 6/1986 Metiver ..... 441/74
5,125,650 A * 6/1992 Paris ..... 482/142
D398,399 S * 9/1998 Vincent et al. ..... D24/200
6,494,816 B1 * 12/2002 Corrado ..... 482/79

* cited by examiner

*Primary Examiner*—Nicholas D. Lucchesi
*Assistant Examiner*—Lori Baker Amerson
(74) *Attorney, Agent, or Firm*—Welsh & Flaxman LLC

(57) ABSTRACT

A therapeutic back stretching device that stretches and relaxes the muscles in the lumbar section of the spine as well as concomitant muscles, such as the abdominal muscles. The device includes a rigid base constructed from a strong rigid lightweight plastic material. The base has two opposed ends with a plurality of spaced parallel slots between which is selectively fit an arched insert. The insert being formed from a lightweight flexible material and includes an opening in the center thereof to accommodate the spine of a user. The insert can be fit between slots closer or further apart to vary the degree of curvature.

17 Claims, 2 Drawing Sheets

LUMBAR STRETCHER

BACKGROUND OF THE INVENTION

1. Field of the Invention

The invention relates generally to an exercise device and more specifically to a therapeutic back stretching device. The device supports and stretches the muscles of a user's back and may be adjusted to present a higher or lower arched angle of contact.

2. Description of the Prior Art

Total body exercise and stretching are increasingly recognized as an important and beneficial tool for healthy living. Regular muscular use increases one's physical and emotional well-being and decreases the likelihood of health problems typically associated with aging. Additionally, stretching one's muscles before exercising prevents strains and pulls. In fact, golfers have come to recognize that lumbar stretching is important to their game. Of course, stretching generally increases one's mobility and flexibility.

Various conditioning methods exist, including cardiovascular, resistance, and free-weight regimens. Yet other exercises focus on specific muscular groups and are facilitated by devices allowing the user to concentrate their effort in one area. In any case, exercise regimens require a routine of stretching.

In particular, proper conditioning includes stretching the abdominal and back muscles as these areas are critical for maintaining the integrity of the lower back. They are particularly critical given the interplay between the lower back and mobility. In fact, lower back and abdominal injuries are potentially debilitating. Infrequently stretched or exercised lower back muscles decrease general mobility and flexibility. Any such activities have to be done without overly stressing the relevant muscles. Thus, back specific stretching and exercising routines require that special equipment be effective and safe.

Anatomically, the human spine has three physiologic curves. The top curve is the cervical region, having a lordotic curvature (i.e., anterior convexity). Next is the thoracic region which is convex posteriorly. The lowest curve is the lumbar region. The lumbar is also lordotic but is more highly curved than the thoracic curve. The present invention relates to the lumbar area of the spine.

Various types of back stretching devices have been disclosed. For example, Longfellow in U.S. Pat. No. 2,010,766 devised a hyper-extension base with adjustable means. However, the base requires movable parts and a jack to adjust the height of the arch.

U.S. Pat. No. 2,264,046 to McClellan teaches a back bolster for sit-ups that attaches to a platform. The bolster is slidable along the length of the platform. The need to attach the bolster to a platform may deter daily use. Similarly, Taltre's U.S. Pat. No. 4,927,139 discloses a therapeutic back rest with a fixed height. The invention is designed to support the entire body, as opposed to stretching a particular or targeted set of muscles. Furthermore, the device cannot be easily stored or moved due to its size.

Koch, Jr. discloses a lower back muscle exercise in U.S. Pat. No. 5,611,765. The angles of the inclined surfaces are adjustable. Likewise, U.S. Pat. No. 5,755,647 to Watnik teaches an abdominal muscle exercising device wherein a lumbar support member is placed under the user's back. The surface is yieldable but allows a user to select the degree of resistance provided by the contact surface.

The present invention relates to a product specifically designed to stretch and relax the muscles in the lumbar region of the spine. The invention overcomes the problems with prior art and improves upon the designs previously used.

SUMMARY OF THE INVENTION

It is, therefore, an object of the present invention to provide a therapeutic back stretching device which overcomes the shortcomings of present devices. The device specifically stretches and relaxes the muscles in the lumbar section of the spine as well as concomitant muscles, such as the abdominal muscles. The device includes a rigid base constructed from a strong yet lightweight plastic material. The base has two ends, two sides, and an insert. The first end, meant to be located perpendicularly lower on the user's back, is slightly wider than the second end, located perpendicularly higher on the user's back. The sides, therefore, taper inward from the first to second end. The first end has a single, parallel slot for holding a flexible insert. The second end has four parallel slots, shaped and dimensioned to hold the flexible insert. The rigid, yet flexible, plastic insert slides into the slot at the first end. The other end of the insert is then selectively slid into one of the four slots on the second end of the base depending on the degree of curvature the user wishes to achieve.

It is a further object of the invention to provide a therapeutic back stretching device, and a method of using the same, which safely and effectively stretches the muscles in the lumbar section of the spine.

It is still a further object of the invention to provide a lightweight, yet strong, therapeutic back stretching device that is easy to adjust, disassemble, transport, use, and store.

It is yet further object of the instant invention to provide a device for stretching lower back and abdominal muscles which is easy and inexpensive to manufacture.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
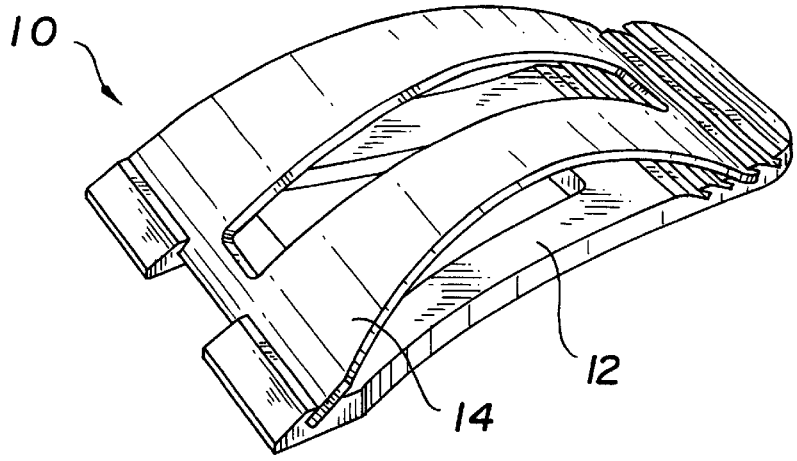
FIG. 1 is a perspective view of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 through 6, a therapeutic back stretching device 10 comprising a rigid base 12 and a flexible, adjustable insert 14 is disclosed. The device 10 is particularly suited for stretching exercises for the lumbar portion of the back, but also relates to stretching the abdomen or other related muscles. Specifically, the insert 14 has an opening 18 for accommodating the spine of the user and has a first end 11 and a second end 15. Likewise, the base 12 includes an opening 20 in its middle for aesthetic purposes. The opening in the base 20 also facilitates carrying the base and reduces the weight and material cost of the device 10.

The base 12 has a first end 13, a second end 16, and two opposite sides 26, 28. In the preferred embodiment, the first end 13 is designed to be located at the base of the user's lumbar section, transverse to the direction of the spine and includes a cutout section 17 to accommodate the user's tail bone. The first end 13 being slightly longer than the second end 16, the sides 26, 28 taper in from the first end 13 to the second end 16. The generally triangular shape thereby providing more support to a user's lower back portion. The second end 16 is then located near the top of the user's lumbar section.

Each end 13, 16 has at least one slot parallel thereto for the placement of the insert 14. One end has a plurality of slots to allow the insert 14 to be adjusted to various arch angles. Preferably, a single slot 30 is placed inside the first end 13, however, it contemplated that a plurality of slots could be used. Four or more slots 32, 34, 36, 38 are located at the second end 16. The slots 30, 32, 34, 36, 38 are shaped to angle towards the middle of the base 12. Therefore, slots at the opposite ends of the base angle toward each other. The insert 14 is dimensioned for insertion into the slots, wherein the first end 11 is about the same length as the first end 13 of the base 12 and tapers down into second end 15 which is about the same length as the second end 16 of the base 12. As such when the device is assembled it generally appears to have a triangular configuration, thereby providing more support to a user's lower back portion.

The base 12 and insert 14 can be made of any molded material which would be well known to one skilled in the art. The base 12 may be made of any suitable material so long as it is rigid, strong and light. Preferably a low-cost plastic material of sufficient strength is used. The insert 14 should also be a strong, light material. However, it must contain a degree of flexibility in order to create various arch angles as it is bent and fit in to the slots. Preferably, a plastic mold with less rigidity than the base 12 is used. However, alternate materials of sufficient strength would also be appropriate.

Figure 2:
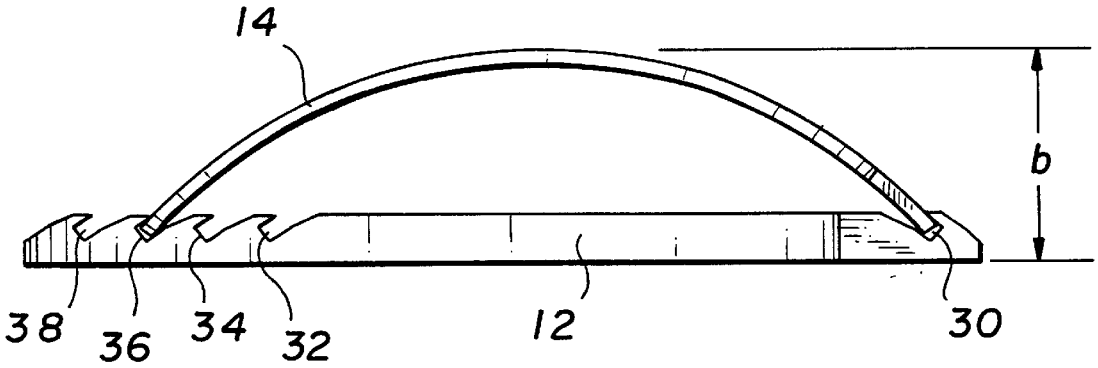
FIG. 2 is a side view of the base with the insert connected to present the next-to-lowest arch angle.
Figure 3:
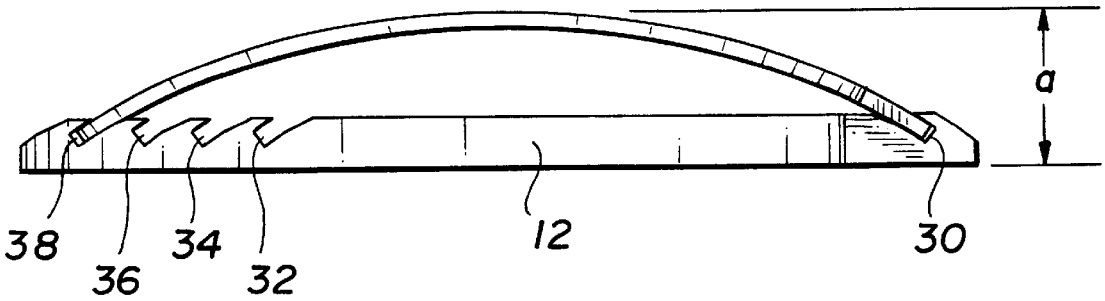
FIG. 3 is a side view of the base with the insert connected to present the lowest arch angle.
Figure 4:
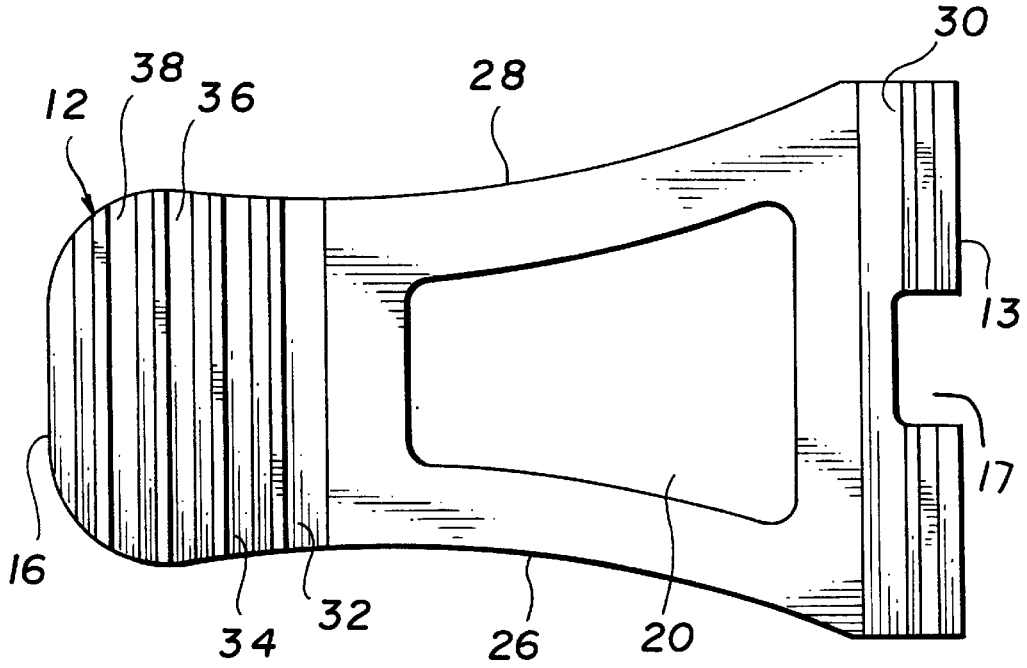
FIG. 4 is a top view of the base.
Figure 5:
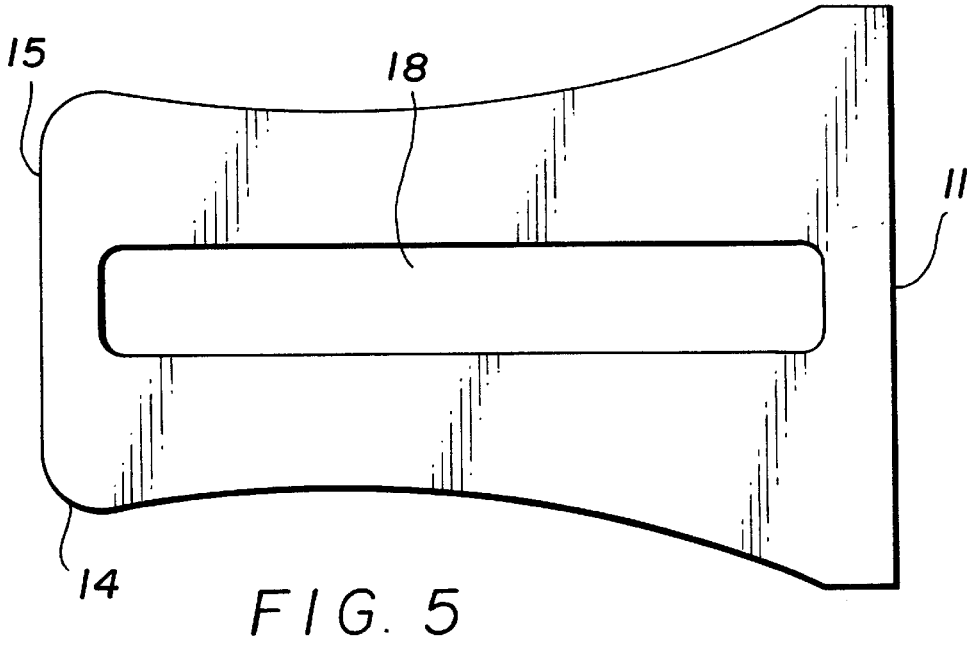
FIG. 5 is a top view of the insert.
Figure 6:
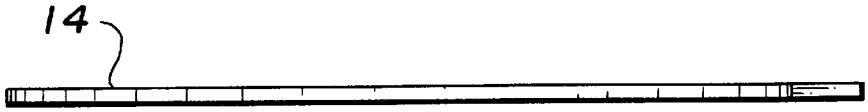
FIG. 6 is a side view of the insert.

With reference to FIGS. 1–3, the flexible, strong insert 14 is selectively connected to the base 12 at various arch angles. FIG. 2 depicts the insert 14 at a level (b), meaning it is inserted at slot 30 and slot 36 and has the next to smallest arch. FIG. 3 depicts the insert 14 at a level (a), the lowest setting, which results in the smallest arch. Here, the insert 14 is inserted into slot 30 and slot 38, the two slots that are farthest away from each other. This creates a very low arch level in the insert and is intended for beginning user's or those that are inflexible. Conversely, at the highest setting, the insert 14 would be placed in slot 30 at the first end 13. The other end of the insert 14 would rest in the slot 32, creating the shortest distance or most bow.

In general, the specific design of the back stretching device 10 is optimized to cooperate with the natural curvatures of a large number of users' backs. The adjustable feature also allows a user to increase the amount of stretch the device delivers as their flexibility increases. The insert 14 can be easily adjusted due to the slot design, encouraging frequent use. Furthermore, the insert 14 is detachable, making the device is easy to store and transport.

In operation, a user first assembles the back stretching device 10 by placing insert 14 into a selected pair of slots on the base 12. The slots are selected depending upon the desire arch height. The user then places the assembled back stretching device 10 on the ground with cutout section 17 in alignment with their tail bone and lay down such that insert 14 engages their back. The weight of the user and the arch of the insert cooperate to stretch the user's lower back.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A back stretching device designed to be positioned on the ground under the lumbar portion of a user's back, comprising:

a base formed of a rigid material having a first end and a second end, wherein each end includes at least one slot shaped and dimensioned for selectively and respectively receiving first and second ends of an insert;

one of said ends including a plurality of spaced parallel slots; and a bendable insert having a first and second end selectively secured to said base, wherein the insert is bent into an arch and the first and second end of the insert respectively fit between slots on said first and second end of the base and is selectively adjustable between said slots to vary the height of the arch formed by said insert.

2. An exercise device according to claim 1, wherein the base has one slot at said first end and at least three parallel spaced slots at said second end.

3. An exercise device according to claim 1, wherein the insert is a lightweight plastic material.

4. An exercise device according to claim 1, wherein the base is a rigid lightweight plastic material.

5. An exercise device according to claim 1, wherein the base has an opening formed between the ends thereof to reduce the overall weight of the device.

6. An exercise device according to claim 1, wherein the insert has an opening formed between the ends thereof to accommodate a user's spine.

7. An exercise device according to claim 1, wherein the first end of the insert is longer than the second end of the insert, thereby providing more support to a user's lower back portion.

8. An exercise device according to claim 1, wherein the first end of the base is longer than the second end of the base, thereby providing more support to a user's lower back portion.

9. An exercise device according to claim 1, wherein said at least one slot on the first end of the base is opened at an angle extending towards the second end of the base.

10. An exercise device according to claim 1, wherein said at least one slot on the second end of the base is opened at an angle extending towards the first end of the base.

11. An exercise device according to claim 1, wherein said first end of said base includes a cutout section to accommodate the tail bone of a user.

12. A back stretching device designed to be positioned on the ground under the lumbar portion of a user's back, comprising:

a base formed of a rigid material having a first end with a central cutout section to accommodate a user's tail bone and a second end, wherein each end includes at least one slot shaped and dimensioned for selectively and respectively receiving first and second ends of an insert;

one of said ends including a plurality of spaced parallel slots; and a bendable insert having a first and second end selectively secured to said base, wherein the insert is bent into an arch and the first and second end of the insert respectively fit between slots on said first and second end of the base and is selectively adjustable between said slots to vary the height of the arch formed by said insert.

13. An exercise device according to claim 12, wherein the base has one slot at said first end and at least three parallel spaced slots at said second end.

14. An exercise device according to claim 12, wherein the insert has an opening formed between the ends thereof to accommodate a user's spine.

15. An exercise device according to claim 12, wherein the first end of the insert is longer than the second end of the insert, thereby providing more support to a user's lower back portion.

16. An exercise device according to claim 12, wherein the first end of the base is longer than the second end of the base, thereby providing more support to a user's lower back portion.

17. An exercise device according to claim 12, wherein said at least one slot on the first end of the base is opened at an angle extending towards the second end of the base.

* * * * *